US006341508B1

(12) United States Patent
Minassian

(10) Patent No.: US 6,341,508 B1
(45) Date of Patent: Jan. 29, 2002

(54) MANUALLY OPERATED DEVICE FOR WASHING CLOTHES AND THE LIKE

(75) Inventor: Shane Minassian, Studio City, CA (US)

(73) Assignee: Arthur Minassian, Los Angeles, CA (US)

( * ) Notice: Subject to any disclaimer, the term of this patent is extended or adjusted under 35 U.S.C. 154(b) by 0 days.

(21) Appl. No.: 09/475,876

(22) Filed: Dec. 30, 1999

(51) Int. Cl.[7] ..... D06F 5/02
(52) U.S. Cl. ..... 68/215; 68/218
(58) Field of Search ..... 68/213, 215, 218, 68/94

(56) References Cited

U.S. PATENT DOCUMENTS

| | | | | | |
|---|---|---|---|---|---|
| 225,392 | A | * | 3/1880 | Keller, Jr. | 68/215 |
| 523,601 | A | * | 7/1894 | Sheehy | 68/213 |
| 597,333 | A | * | 1/1898 | Snow | 68/215 |
| 659,296 | A | * | 10/1900 | Flesher et al. | 68/215 |
| 742,754 | A | * | 10/1903 | Trimble | 68/215 |
| 878,190 | A | * | 2/1908 | Crooker | 68/215 |
| 879,313 | A | * | 2/1908 | Perry et al. | 68/215 |
| 1,099,400 | A | * | 6/1914 | Sciarrett | 68/215 |
| 1,107,939 | A | * | 8/1914 | Halliday | 68/215 |
| 1,109,494 | A | * | 9/1914 | Whitman | 68/215 |
| 1,114,974 | A | * | 10/1914 | Fay | 68/215 |
| 1,193,348 | A | * | 8/1916 | Bays | 68/215 |
| 1,271,852 | A | * | 7/1918 | Cauley | 68/215 |
| 2,008,556 | A | * | 7/1935 | Kubista | 68/122 |
| 2,320,230 | A | * | 5/1943 | Glisson | 68/215 |

FOREIGN PATENT DOCUMENTS

| | | | | |
|---|---|---|---|---|
| AU | 14155 | * | 8/1933 | 68/215 |
| AU | 20931 | * | 1/1935 | 68/215 |
| GB | 106414 | * | 5/1917 | 68/215 |

* cited by examiner

*Primary Examiner*—Frankie L. Stinson
(74) *Attorney, Agent, or Firm*—Alan R. Davis

(57) ABSTRACT

The invention is a manually operated device for washing clothes and the like. In detail, the invention includes a rod shaped handle having first and second ends. A first hollow cone shaped member has a truncated top end attached to the first end of the rod and an open bottom end. This first cone shaped member includes a plurality of holes about its periphery in proximity to the top end thereof, with the plurality of holes having a first total cross-sectional area. An inverted cup shaped member is provided having a closed top end and an open bottom end, the inverted cup shaped member is mounted within the first cone shaped member such that the top end of the inverted cup shaped member is in contact with the interior wall of the first cone shaped member forming a first interior chamber. The closed top end includes a hole therethrough with a total second cross-sectional area greater than the first cross-sectional area of the plurality of holes in the first cone shaped member. A second hollow cone shaped member having a truncated first end with a hole therethrough and a second end in contact with and joined to the closed top end of the inverted cup forming a second chamber therebetween. The second hollow cone has a corrugated surface between the top and bottom ends thereof. The second cone shaped member preferably includes flow passages between the corrugations on the second end thereof in communication with the second chamber.

6 Claims, 3 Drawing Sheets

MANUALLY OPERATED DEVICE FOR WASHING CLOTHES AND THE LIKE

BACKGROUND OF THE INVENTION

1. Field of the Invention

The invention relates to the field of washing devices for clothes and the like and, in particular, to a manually operated washing device.

2. Description of Related Art

The automatic washing machine is universally accepted as the most practical home clothes cleaning device. However they are expensive and require electrical power. This rules out their use in areas where there is no readily available electrical power, which is particularly the case in the poorer third world countries. What makes these powered washing machines effective is the cleaning action of the agitation system. In the top loading machines, the back and forth rotation of a finned central column or its up and down motion circulates the soapy water through the soiled clothes removing the dirt and/or stains. In the front loading machines, it is the tumbling action caused by the fins mounted within the drum.

Many manually operated devices for washing clothes and the like are also effective, for example, the corrugated washing board. However, its use requires a great deal effort. An individual must remove the wet clothes from the tub and "rub" the clothes across the corrugated washing surface. Some what less effective are the numerous manually operated rotating drum type devices where the clothes, soap and water are added to the drum and a hand crank is used to rotate it. Both vertical and horizontal rotating drums are available. However, these are generally limited in size for use on tabletops. If they become much larger in size, it becomes difficult to crank the drum. In addition, they also become difficult to empty of water unless placed in a sink. Finally, they have not proved popular because they are prone to leaking.

Thus, it is a primary object of the invention to provide a manually operated device for washing clothes and the like.

It is another primary object of the invention to provide a manually operated device for washing clothes and the like that provides agitation action.

It is a further object of the invention to provide a manually operated device for washing clothes and the like that is simple to manufacture.

It is a still further object of the invention to provide a manually operated device for washing clothes and the like that is simple to operate.

SUMMARY OF THE INVENTION

The invention is a manually operated device for washing clothes and the like. In detail, the invention includes a rod shaped handle having first and second ends. A first hollow cone shaped member has a truncated top end attached to the first end of the rod and an open bottom end. This first cone shaped member includes a plurality of holes about its periphery in proximity to the top end thereof, with the plurality of holes having a first total cross-sectional area. An inverted cup shaped member is provided having a closed top end and an open bottom end mounted within the hollow cone shaped member such that the top end is in contact with the interior wall of the hollow cone shaped member forming a first interior chamber. The closed top end includes at least one hole therethrough with a total second cross-sectional area greater than the first cross-sectional area of the plurality of holes in the first hollow cone shaped member.

A second hollow cone shaped member is provided having a truncated first end with a hole therethrough and a second end in contact with and joined to the closed top end of the inverted cup shaped member thus forming a second chamber therebetween. The second hollow cone shaped member has a corrugated surface between the top and bottom ends thereof. The second hollow cone shaped member preferably includes flow passages between the corrugations on the second end thereof in communication with the second chamber. Preferably, a third cone shaped member having a truncated top end is attached to the truncated first end of the first cone shaped member and an open bottom end extending beyond the holes in the first cone shaped member in a spaced relationship thereto.

With a large pot, tub or sink filled with water and dirty washables such as clothes and the like, the device is used in the following manner. The device is grabbed by the second end of the rod and inserted into the water until the first cone shaped member is partially immersed, preferably over a washable item. By pushing the rod down in this manner, water is forced downward through the washables. Simultaneously, water is pushed up through the second hollow cone shaped member and into the second chamber, through the at least one second holes into the first chamber and out the holes in the first cone shaped member. When the rod is pulled upward, a vacuum/suction effect is created, which again sends a rush of water up through the washables. Repeated strokes soon clean the washables.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

DESCRIPTION OF THE PREFERRED EMBODIMENT

Figure 1:
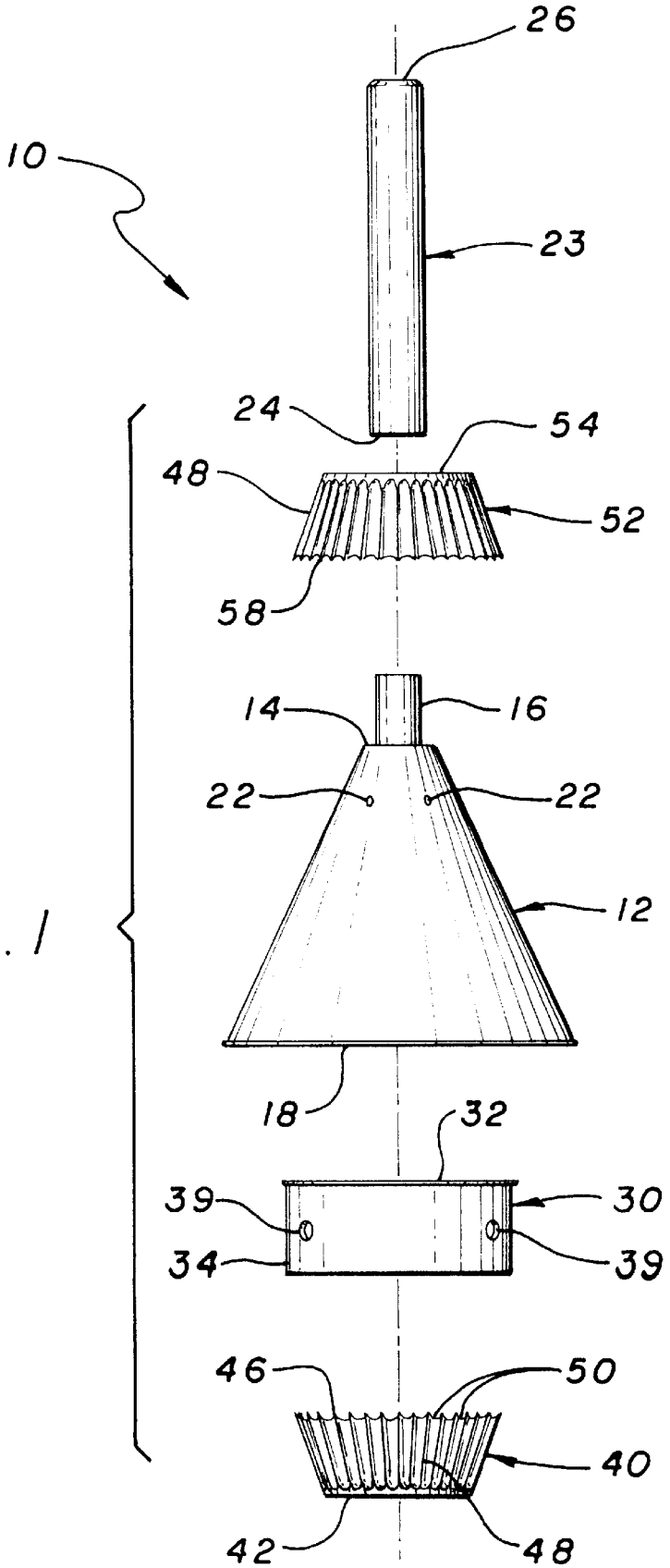
FIG. 1 is an exploded side view of the device.
Figure 2:
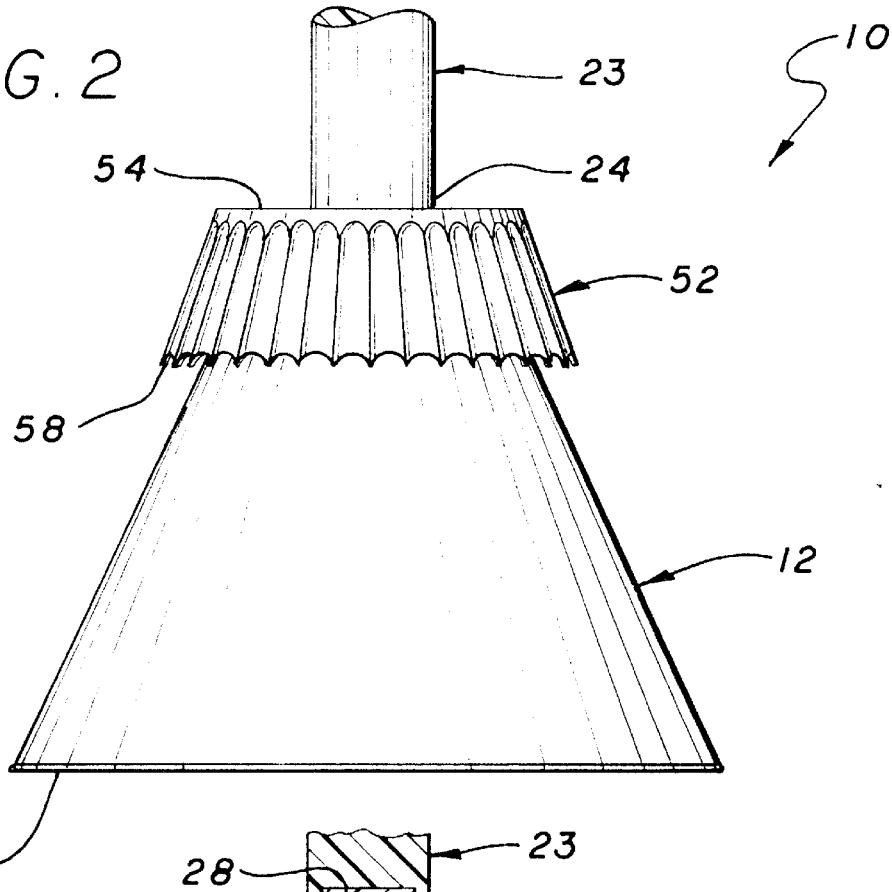
FIG. 2 is an assembled side view of the device shown in FIG. 1.
Figure 3:
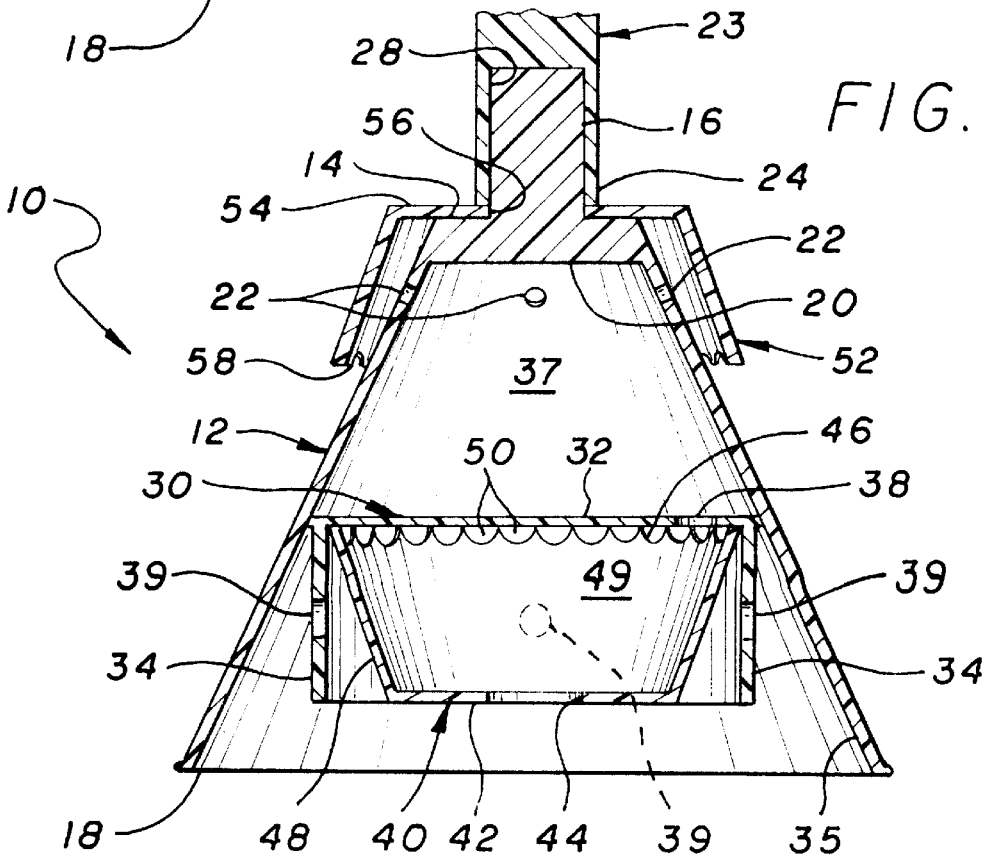
FIG. 3 is a cross-sectional view of the device shown in FIG. 2.

Referring to FIGS. 1–3, the device, generally indicated by numeral 10, includes a first hollow cone shaped member 12 having a flat truncated top end 14 with a short shaft 16 protruding therefrom and an open bottom end 18. A wall 20 partitions off the interior of the cone shaped member 12 at the top end 14. Just below the wall 20 are a plurality of holes 22 spaced from each other about the periphery thereof, having a combined first total cross-sectional area. A round rod 23 having first and second ends 24 and 26, respectively, includes a recess 28 in the first end, which engages the short shaft 16 and is held thereto by friction. The length of the rod 23 should be between 18 to 24 inches in length to insure that the device 10 can be properly griped when in use (to be subsequently discussed).

Mounted within the first cone shaped member 12 is an inverted cup shaped member 30 having a center portion 32 and a side wall 34. The center portion 32 is joined to the inner wall 35 of the cone shaped member 12 forming a chamber 37 between the side center portion 32 of the cup shaped member 30 and the cone shaped member 12. The side wall 34 of the cup shaped member 30 extends downward but remains within the interior of the cone shaped member 12. The center portion 32 of the inverted cup shaped member 30 includes a hole 38 that has a second cross-sectional area greater than the combined first cross-sectional area of holes 22 in the cone shaped member 12.

Mounted within the inverted cup shaped member 30 is second cone shaped member 40 having a first truncated end 42 with a hole 44 therein and an open second end 46, and a corrugated type outer surface 48 therebetween. The second cone shaped member 40 is joined to the inverted cup shaped member 30 at the junction of the center portion 32 and side wall 34 thereof forming a second chamber 49. As illustrated, the corrugated surface 48 produces flow channels 50 between the open end 46 and center portion 32 of the inverted cup shaped member 30. Of course, the second cone shaped member 40 could be non-corrugated and have notches at the second end 46 to provide flow channels (not illustrated).

A third cone shaped member 52 includes a truncated first end 54 with a hole 56 fitted over the shaft 16. This is accomplished prior to the rod 23 being frictionally attached to the shaft 16. The open second 58 extends downward over the first cone shaped member 12 spaced therefrom and terminates beyond the holes 22.

Figure 4:
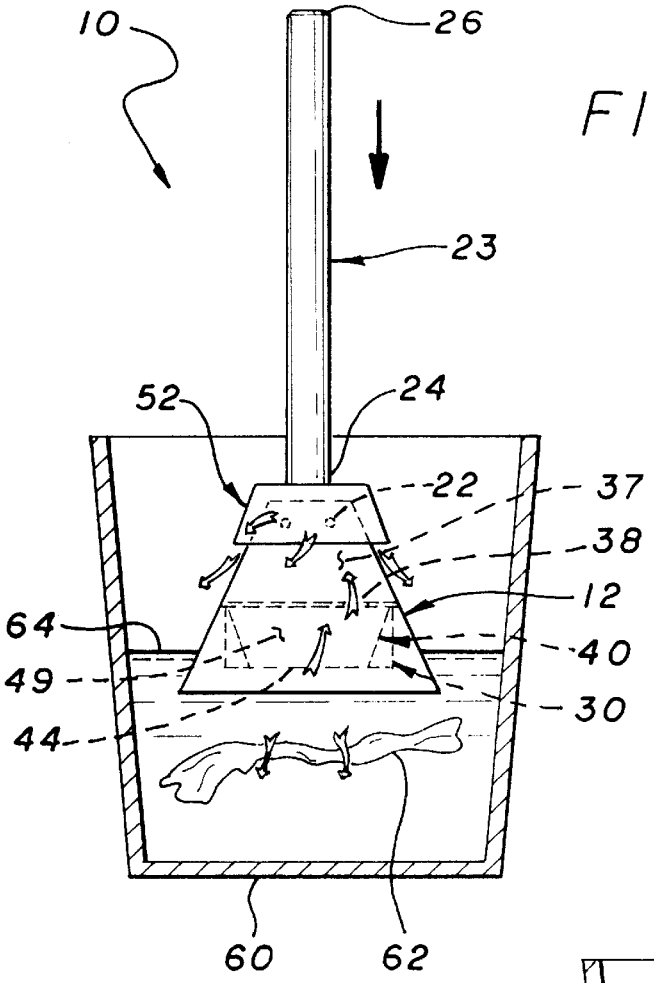
FIG. 4 is a partial view of the device shown in FIG. 3 partially immersed in a container of water having washables therein, with the device being pushed into the container
Figure 5:
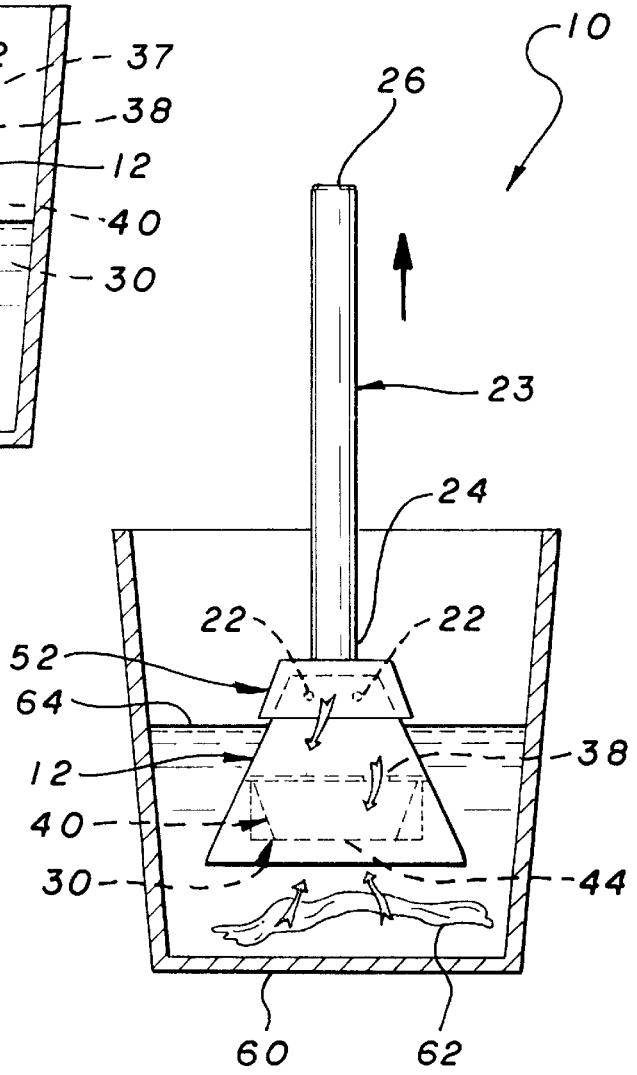
FIG. 5 is a partial view of the device similar to FIG. 4 partially immersed in a container of water having washables therein, with the device being pulled upward out of the container.

Referring particularly to FIGS. 4 and 5, the device 10 is grabbed by the rod 23 and inserted into the water 64 until the first cone shaped member 12 is partially immersed, preferably over a washable 62. By pushing the rod 23 down, water is forced downward through the washables. Simultaneously, water is pushed up through the second cone shaped member 40 and into the chamber 49, through the hole 38 into the chamber 37 and out the holes 22 in the first cone shaped member 12. The third cone shaped member 52 directs the water downward back into the container 60. When the rod 23 is pulled upward, a suction effect is created within the chamber 37 pulling air through holes 22 and the water exits the device 10 through the hole 44 again flowing through the washable 62 in an upward direction. Repeated strokes soon clean the washables. The improved performance is due in part because of the flow area of the holes 22 in the first cone shaped member 12 being less than the flow area of hole 38 in the center portion 32. Because of the constant exposure to water, it is best that the device be completely made of a plastic material.

While the invention has been described with reference to a particular embodiment, it should be understood that the embodiment is merely illustrative as there are numerous variations and modifications, which may be made by those skilled in the art. Thus, the invention is to be construed as being limited only by the spirit and scope of the appended claims.

INDUSTRIAL APPLICABILITY

The invention has applicability to laundry appliance industry.

What is claimed is:

1. A manually operated device for washing clothes and other washable fabrics comprising:

a rod shaped handle having first and second ends;

a first hollow cone shaped member having a truncated top end attached to said first end of said rod and an open bottom end, said first cone shaped member having a plurality of holes about its periphery in proximity to said top end thereof, said plurality of holes having a first total cross-sectional area;

an inverted cup shaped member having a closed top end and an open bottom end mounted within the first hollow cone shaped member such that the top end of the cup is in contact with the interior wall of said first cone shaped member forming an interior chamber therebetween, said closed top end having at least one hole therethrough, said at least one hole in said closed top end having a total second cross-sectional area greater than said first total cross-sectional area of said plurality of holes in said first cone shaped member; and a second cone shaped member having a truncated first end with a hole therethrough and an open second end in contact with said closed top end of said inverted cup forming a second chamber therebetween.

2. The manually operated device as set forth in claim 1 wherein said second cone shaped member has a corrugated surface between said top and bottom ends thereof.

3. The manually operated device as set forth in claim 2 wherein a third cone shaped member having a truncated top end is fitted to said rod above said truncated first end of said first cone shaped member and an open second end extending beyond said holes in said first cone shaped member in a spaced relationship thereto.

4. The manually operated device as set forth in claim 3 wherein said second cone shaped member includes flow passages between the corrugations on said second end thereof in communication with said second chamber.

5. The manually operated device as set forth in claim 4 wherein said rod, first, second and third cone shaped members, and said inverted cup shaped member are made of a plastic material.

6. The manually operated device as set forth in claim 5 including a plurality of holes in said inverted cup shaped member in proximity to said open bottom end.

* * * * *